US007168559B2

(12) United States Patent
Chen

(10) Patent No.: US 7,168,559 B2
(45) Date of Patent: Jan. 30, 2007

(54) TOOLBOX

(76) Inventor: Tsai-Ching Chen, No. 202, Lane 330, Sec. 7, Chang Lu Road, Fu Hsing Hsiang, Chang Hua Hsien (TW)

( * ) Notice: Subject to any disclaimer, the term of this patent is extended or adjusted under 35 U.S.C. 154(b) by 259 days.

(21) Appl. No.: 10/898,438

(22) Filed: Jul. 23, 2004

(65) Prior Publication Data

US 2006/0016706 A1 Jan. 26, 2006

(51) Int. Cl.
*B65D 85/28* (2006.01)

(52) U.S. Cl. ..... 206/373; 206/379

(58) Field of Classification Search ..... 206/372–379, 206/349; 211/70.6; 220/810, 817, 825, 220/827, 830

See application file for complete search history.

(56) References Cited

U.S. PATENT DOCUMENTS

| | | | | |
|---|---|---|---|---|
| 6,050,409 | A * | 4/2000 | Delbeck et al. | 206/375 |
| 6,070,732 | A * | 6/2000 | Chen | 206/751 |
| 2005/0077198 | A1* | 4/2005 | Wikle et al. | 206/373 |
| 2005/0161356 | A1* | 7/2005 | Chen | 206/373 |

* cited by examiner

*Primary Examiner*—Shian T. Luong
(74) *Attorney, Agent, or Firm*—Alan D. Kamrath; Nikolai & Mersereau, P.A.

(57) ABSTRACT

A toolbox includes a body, a first holder pivotally connected with the body between a lie-down position and a stick-out position, a first elastic element for biasing the first holder to the stick-out position, a first lock for locking the first holder in the lie-down position, a second holder pivotally connected with the body between a lie-down position and a stick-out position, a second elastic element for biasing the second holder to the stick-out position, and a second lock for locking the second holder in the lie-down position.

20 Claims, 11 Drawing Sheets

TOOLBOX

BACKGROUND OF INVENTION

1. Field of Invention

The present invention relates to a toolbox.

2. Related Prior Art

Referring to FIGS. 10 and 11, a conventional toolbox includes a case 130, a cover 110, a rack 120, two connectors 140, two shafts 150 and two holders 160. The case 130 includes two lateral walls each defining an aperture 132. The cover 110 includes two lugs 112. Each lug 112 defines an oblong aperture 114. The rack 120 includes two lateral members each defining a groove 121 and an aperture 122. Each connector 140 includes a boss 141 and an oblong aperture 142. Each shaft 150 is oblong in a cross-sectional view. The bosses 141 are put in the grooves 121. The connectors 140 and the rack 120 are put between the lugs 112. The lugs 112 are put in the case 130. The shafts 150 are put in the apertures 132, 114, 142 and 122. Attached to the rack 120 are the holders 160 for tools. As the cover 110 is lifted, the shafts 150 and the connectors 140 are pivoted. The rack 120 will eventually be pivoted due to the insertion of the bosses 141 in the grooves 121. When the cover 110 is completely lifted, the rack 120 is lifted and so are the holders 160. However, the weight of the tools held by the holders 160 often causes the rack 120 to fall. Thus, the cover 110 is lowered, and the case 130 closed. Such accidental closing causes a user troubles in getting the tools. Moreover, while taking tools from the case 130, a user would get hurt by the tools held to the holders 160.

The present invention is therefore intended to obviate or at least alleviate the problems encountered in the prior art.

SUMMARY OF INVENTION

According to the present invention, a toolbox includes a body, a first holder pivotally connected with the body between a lie-down position and a stick-out position, a first elastic element for biasing the first holder to the stick-out position, a first lock for locking the first holder in the lie-down position, a second holder pivotally connected with the body between a lie-down position and a stick-out position, a second elastic element for biasing the second holder to the stick-out position, and a second lock for locking the second holder in the lie-down position.

The primary advantage of the toolbox according to the present invention is the including of elastic elements for retaining the lateral and central holders in the stick-out position. Another advantage is that the lateral and central holders are not hindered by one another.

Other objects, advantages and novel features of the present invention will become more apparent from the following detailed description referring to the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
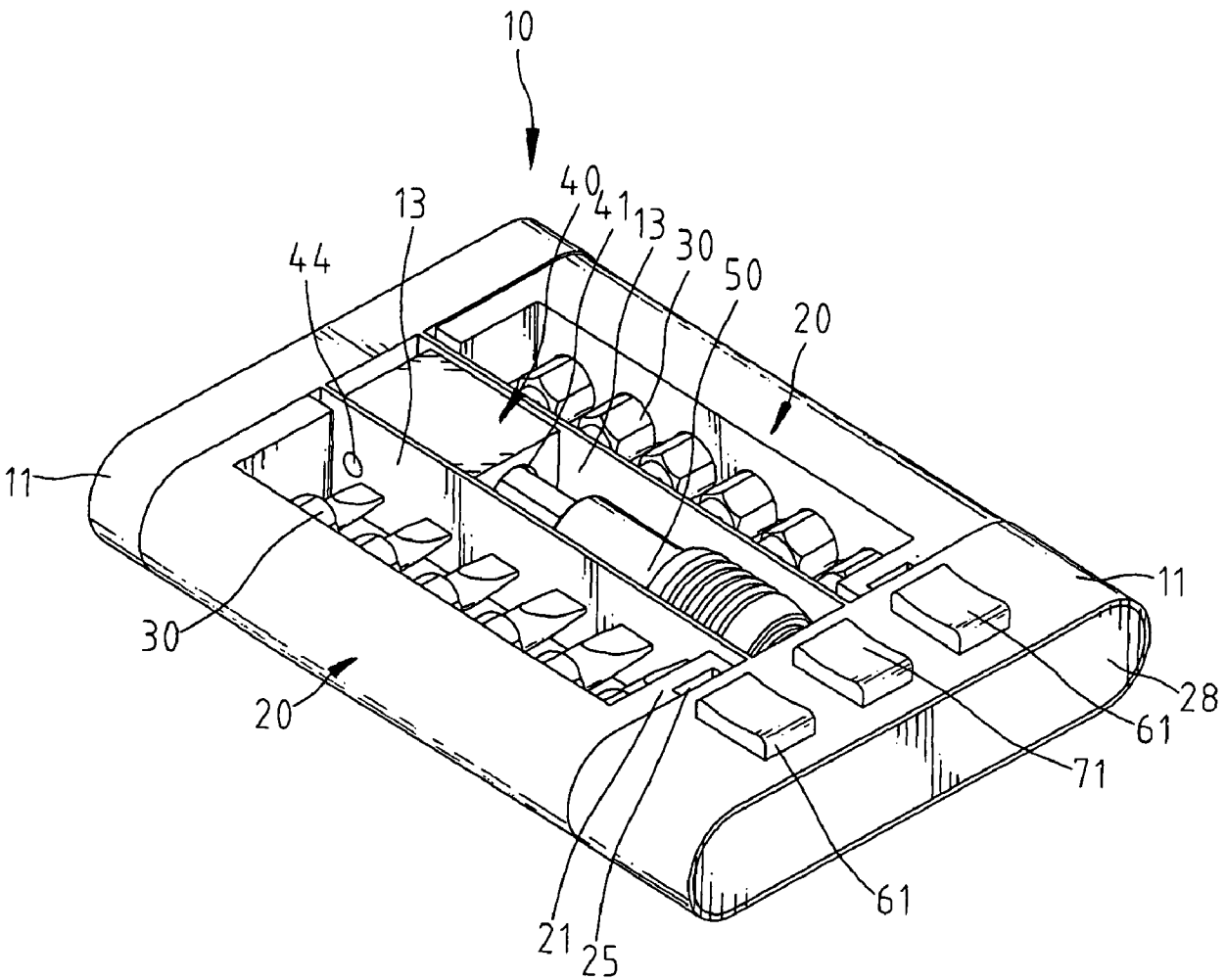
FIG. 1 is a perspective view of a toolbox according to the preferred embodiment of the present invention.
Figure 2:
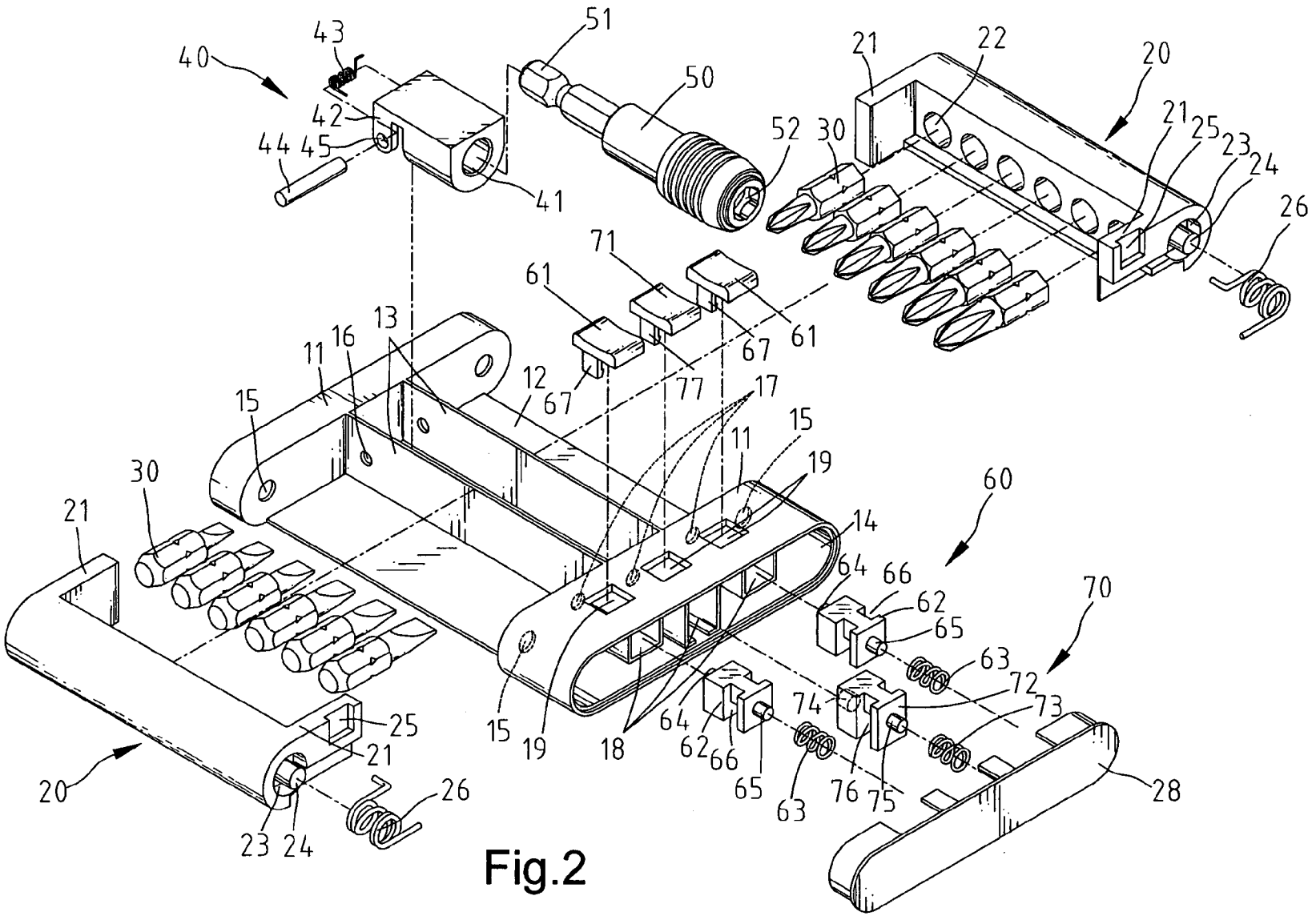
FIG. 2 is an exploded view of the toolbox shown in FIG. 1.

Referring to FIGS. 1 and 2, according to the preferred embodiment of the present invention, a toolbox includes a body 10, two lateral holders 20 pivotally connected with the body 10 between a lie-down position and a stick-out position, a central holder 40 pivotally connected with the body 10 between a lie-down position and a stick-out position, two lateral locks 60 for locking the lateral holders 20 in the lie-down position and a central lock 70 for locking the central holder 40 in the lie-down position.

The body 10 includes a board 12, front and rear walls 11 on the board 12, two partitions 13 on the board 12, and a frame 14 extending forwards from the front wall 11. Each wall 11 defines two apertures 15. The front wall 11 defines three holes 17. Three sub-frames 18 are formed on a lower side of an upper member of the frame 14. Three windows 19 are defined in the upper member of the frame 14.

Each lateral holder 20 includes front and rear walls 21, holes 22 defined therein, a front shaft 24 extending from the front wall 21, a rear shaft 24 extending from the rear wall 21, an annular groove 23 defined in the front wall 21 around the shaft 24 and a recess 25 defined in the front wall 21. The shafts 24 are put in the apertures 15 so as to pivotally connect the lateral holders 20 with the body 10. A torque spring 26 is put around the front shaft 24 and put in the annular groove 23. Because of the torque springs 26, the lateral holders 20 tend to pivot to the stick-out position. Tool bits 30 can be put in the holes 22.

The central holder 40 includes a hole 41 defined therein and two ears 42 formed thereon. Each ear 42 defines an aperture 45. A pin 44 is fit in the apertures 16 and 45. Thus, the central holder 40 is pivotally connected with the body 10. A torque spring 43 is put around the pin 44. Because of the torque spring 43, the central holder 40 tends to pivot from the board 12, i.e., to the stick-out position from the lie-down position. The hole 41 can receive a tool bit 50. The tool bit 50 includes a working tip 51 formed at an end and a recess 52 defined in an opposite end.

Each lateral lock 60 includes a latch 62 and a switch 61. The latch 62 includes a rear protrusion 64, a front protrusion 65 and a waist 66. Each switch 61 includes two hooks 67 extending down. Each latch 62 is put in a related sub-frame 18 with the rear protrusion 64 put in a related hole 17 and the front protrusion 65 put in a compression spring 63. Each pair of hooks 67 is put into a related sub-frame 18 through a related window 19. The hooks 67 of each switch 61 hook the waist 66 of a related latch 62.

The central lock 70 includes a latch 72 and a switch 71. The latch 72 includes a rear protrusion 74, a front protrusion 75 and a waist 76. Each switch 71 includes two hooks 77 extending down. Each latch 72 is put in a related sub-frame 18 with the rear protrusion 74 put in a related hole 17 and the front protrusion 75 put in a compression spring 73. The hooks 77 are put into a related sub-frame 18 through a related window 19. The hooks 77 of the switch 71 hook the waist 76 of the latch 72. The central lock 70 is similar or identical to the lateral locks 60.

The hooks 77 are put into a related sub-frame 18 through a related window 19. The hooks 77 of the switch 71 hook the waist 76 of the latch 72. The central lock 70 is similar or identical to the lateral locks 60.

A cover 28 is fit in the frame 14, thus keeping the latches 62 and 72 and the compression springs 63 and 73 in the frame 14.

Figure 5:
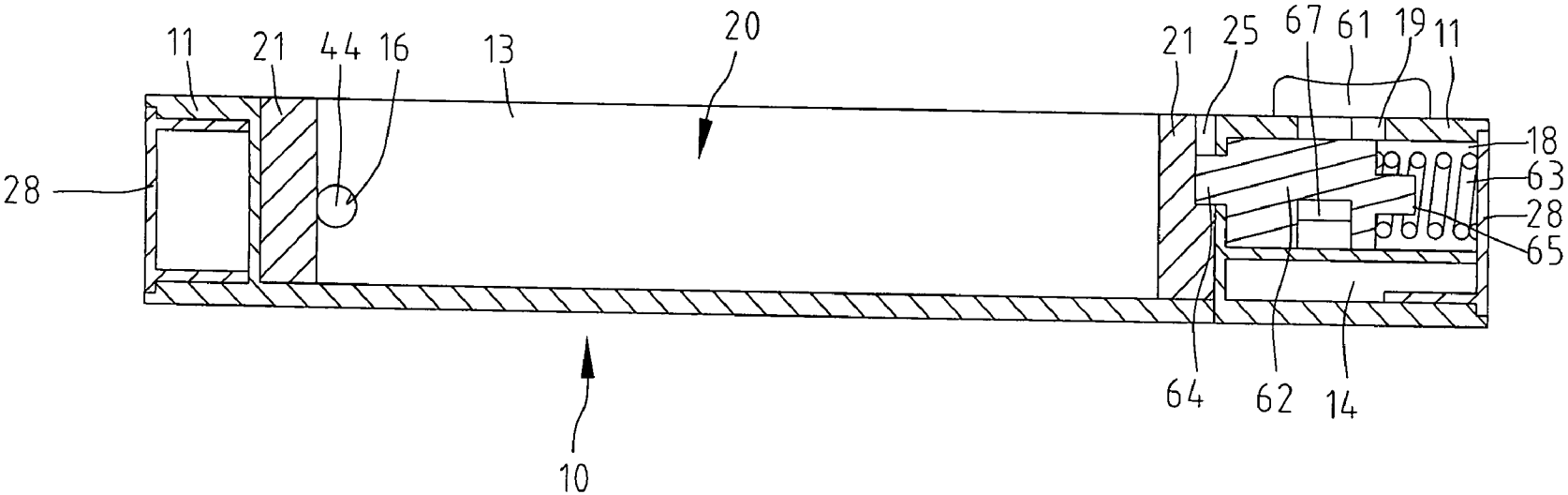
FIG. 5 is a cross-sectional view of the toolbox shown in FIG. 1.
Figure 6:
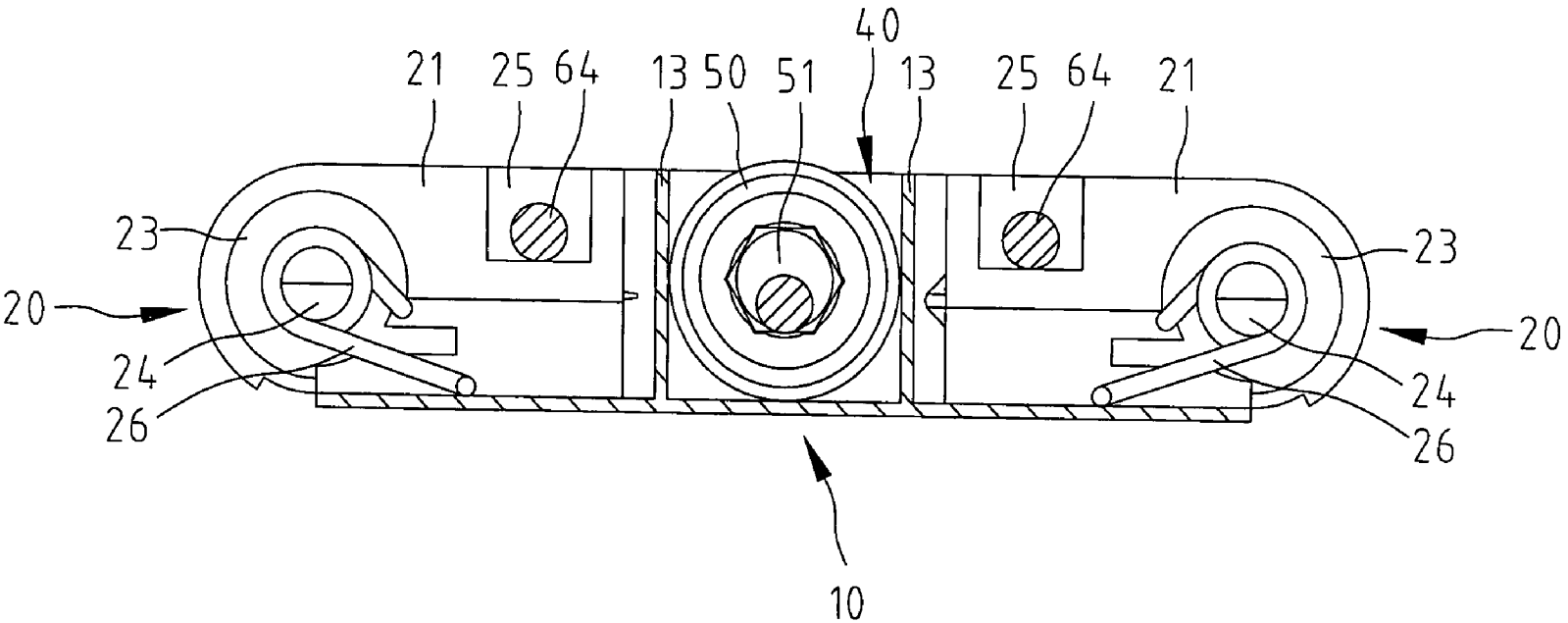
FIG. 6 is another cross-sectional view of the toolbox shown in FIG. 5.
Figure 7:
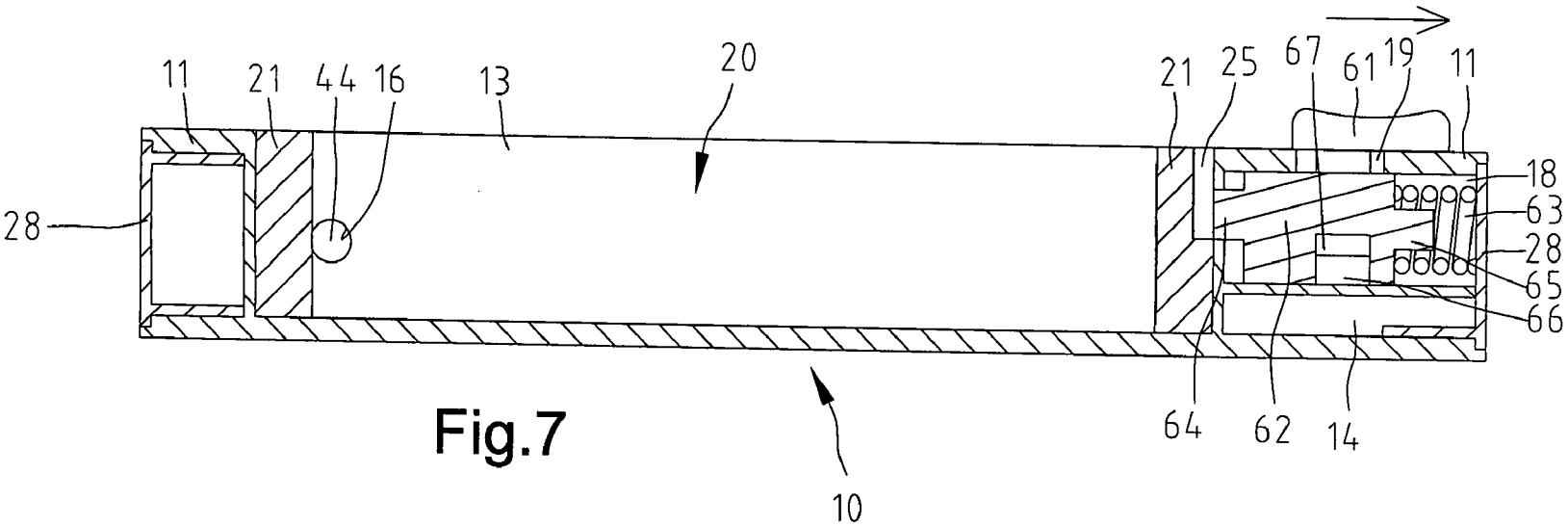
FIG. 7 is a cross-sectional view of the toolbox in another position than that is shown in FIG. 5.
Figure 8:
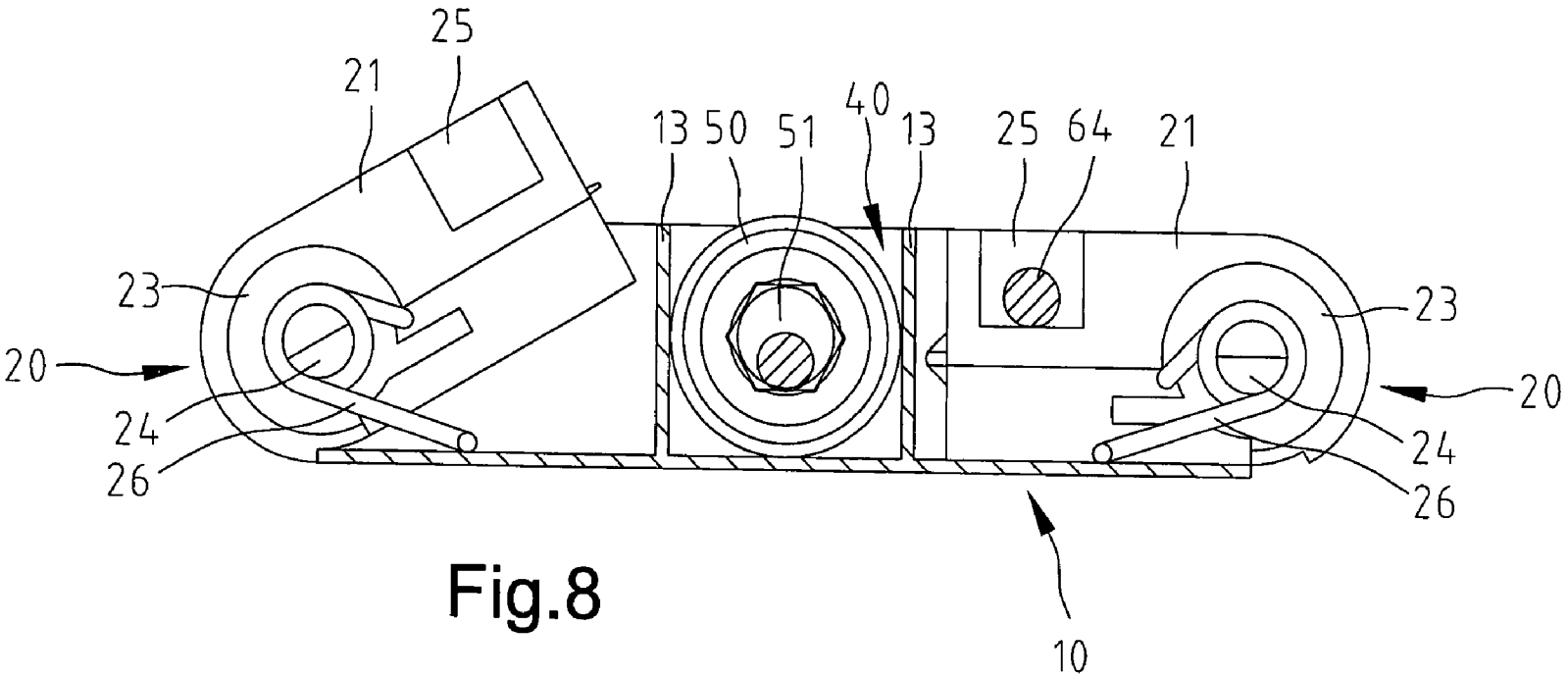
FIG. 8 is another cross-sectional view of the toolbox in another position than that is shown in FIG. 7.
Figure 9:
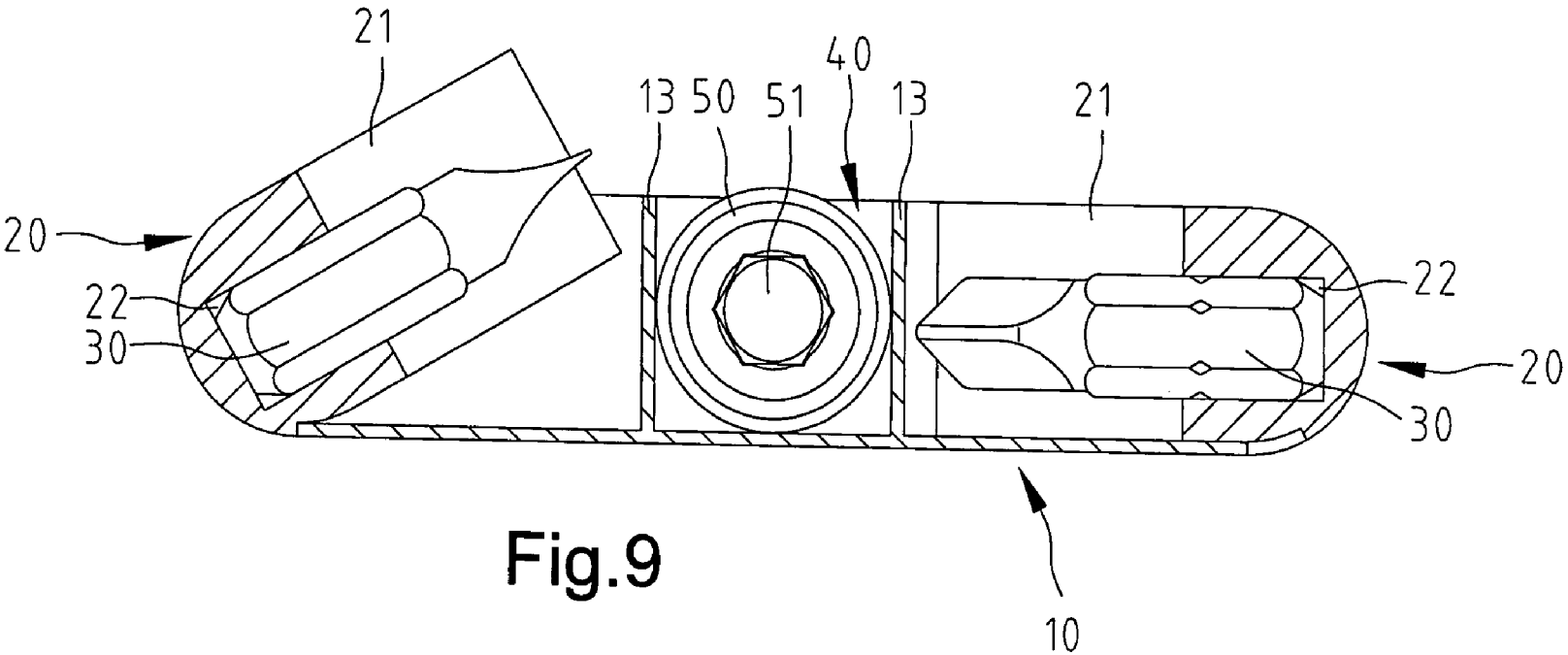
FIG. 9 is another cross-sectional view of the toolbox in another position than that is shown in FIG. 8.
Figure 10:
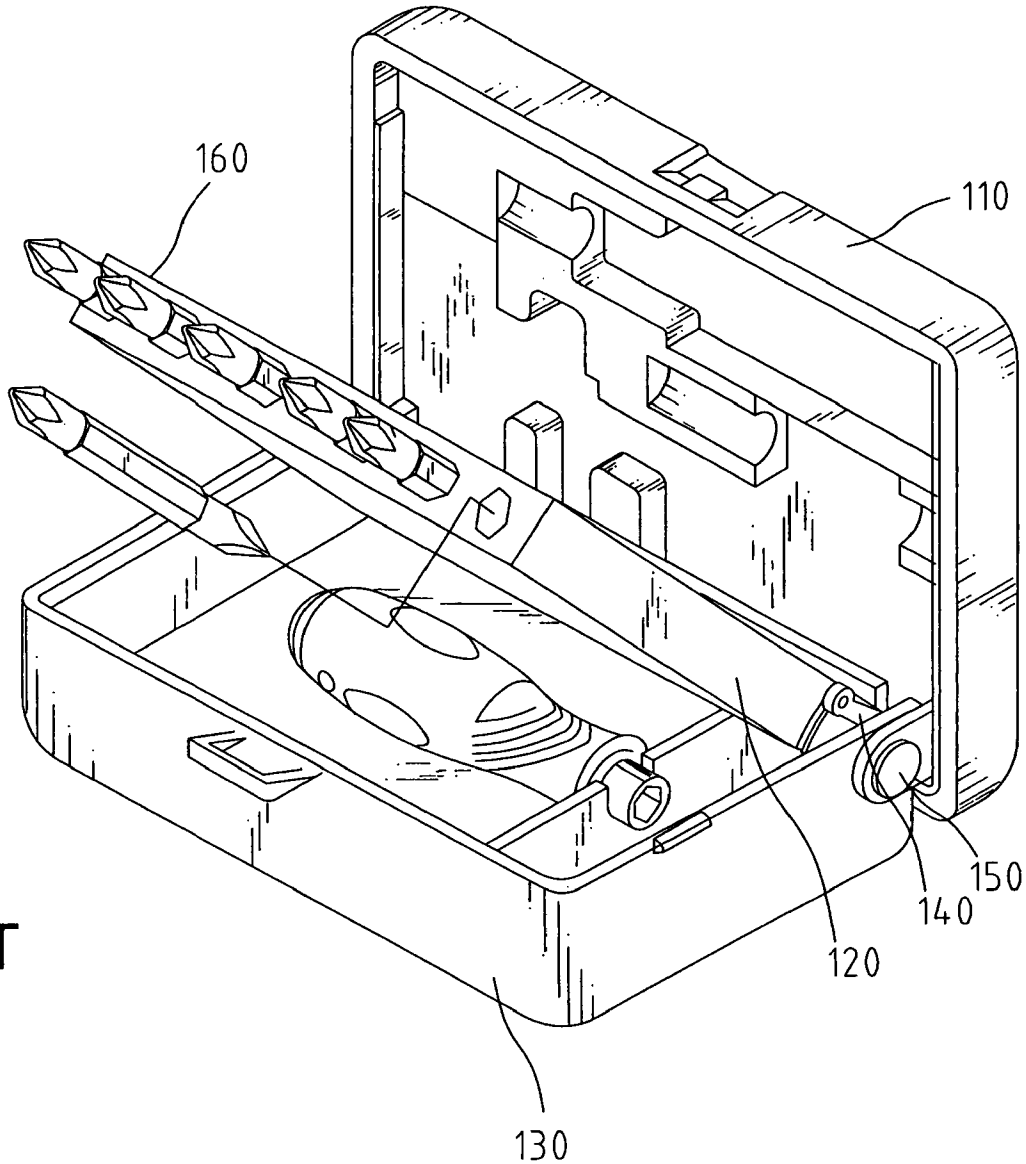
Fig. 10 PRIOR ART
FIG. 10 is a perspective view of a conventional toolbox.
Figure 11:
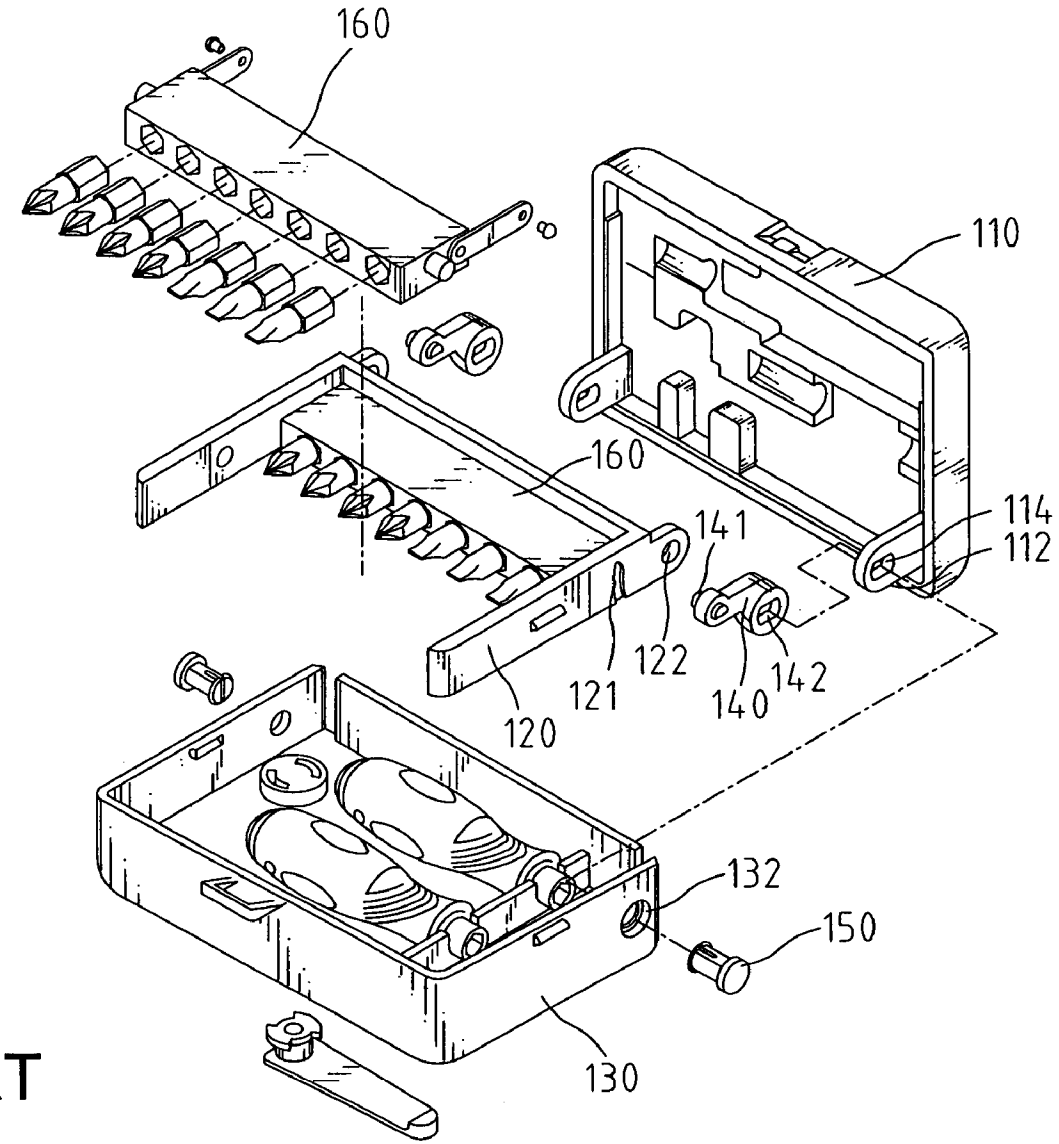
Fig. 11 PRIOR ART
FIG. 11 is an exploded view of the toolbox shown in FIG. 10.

Referring to FIG. 5, a rear protrusion 64 is put in a related hole 25 in order to retain a related lateral holder 20 in the lie-down position as shown in FIG. 6. Referring to FIG. 7, via operating a switch 61, a related rear protrusion 64 is removed from a related hole 25 so as to release a related lateral holder 20 to the stick-out position as shown in FIGS. 8 and 9.

Figure 3:
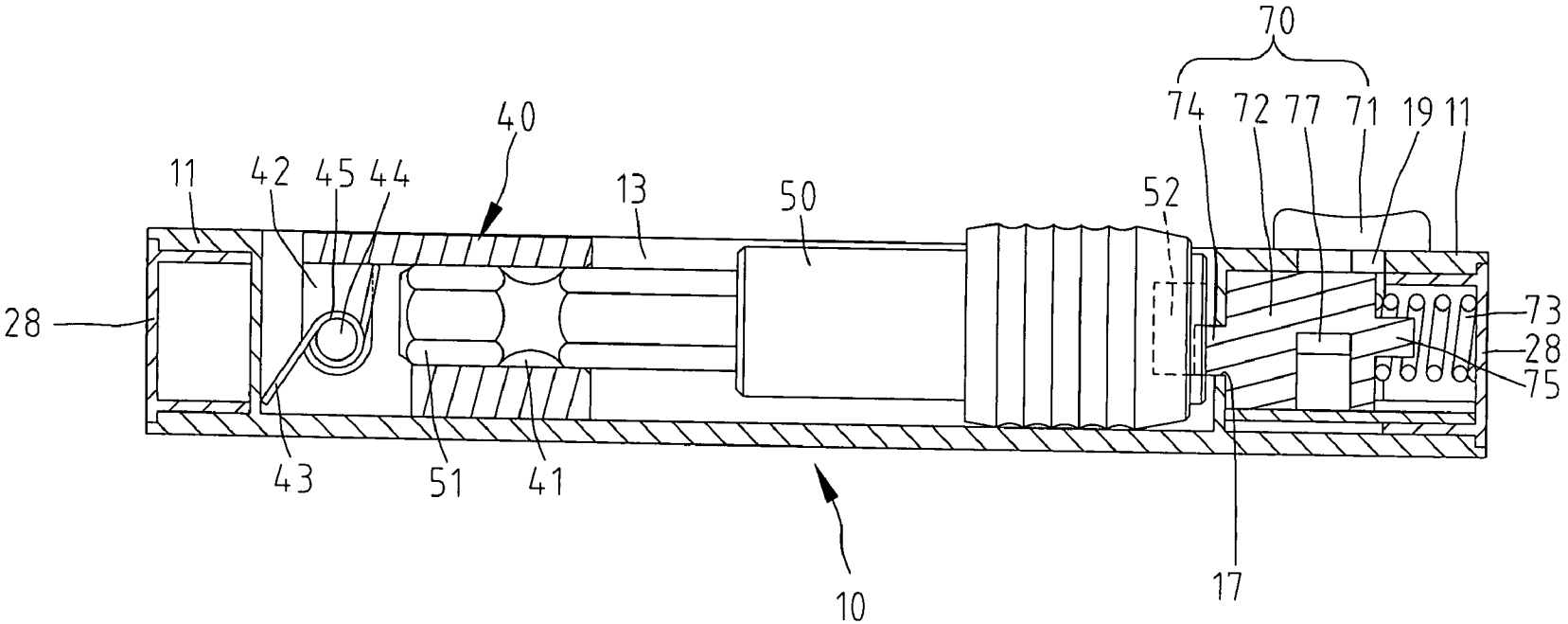
FIG. 3 is a cross-sectional view of the toolbox shown in FIG. 1.
Figure 4:
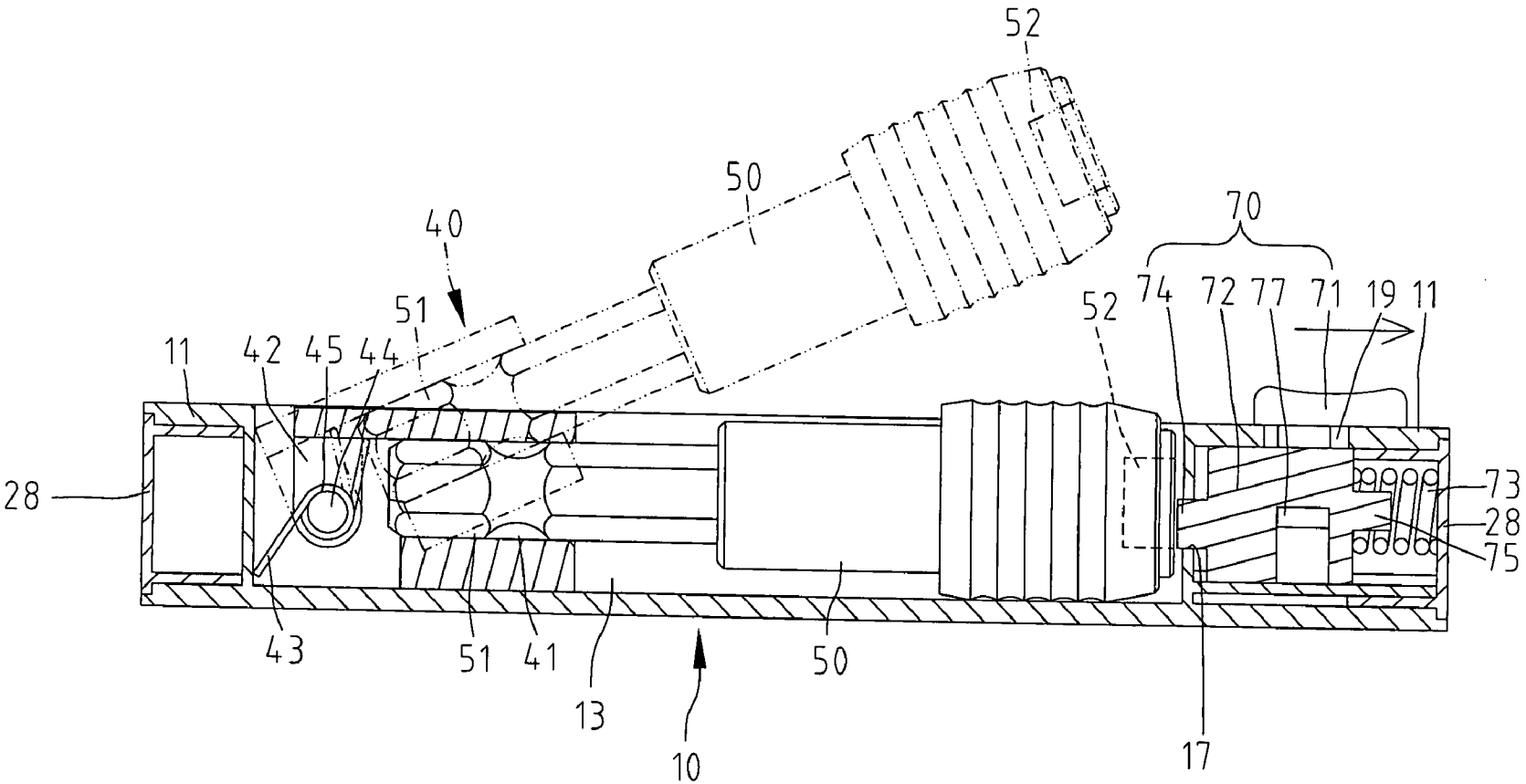
FIG. 4 is a cross-sectional view of the toolbox in another position than that is shown in FIG. 3.

Referring to FIG. 3, the rear protrusion 74 is put in the recess 52 in order to retain the central holder 40 in the lie-down position. Referring to FIG. 4, via operating the switch 71, the rear protrusion 74 is removed from the recess 52 in order to release the central holder 40 to the stick-out position.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A toolbox comprising a body, a first holder pivotally connected with the body between a lie-down position and a stick-out position, a first elastic element for biasing the first holder to the stick-out position, a first lock for locking the first holder in the lie-down position, a second holder pivotally connected with the body between a lie-down position and a stick-out position, a second elastic element for biasing the second holder to the stick-out position, and a second lock for locking the second holder in the lie-down position, wherein the body comprises a front wall, a rear wall, a board extending between the front and rear walls, and a frame extending from the front wall for supporting the first and second locks.

2. The toolbox according to claim 1 wherein the body comprises a cover for closing the frame.

3. The toolbox according to claim 1 wherein the body comprises two sub-frames formed in the frame for receiving the first and second locks.

4. The toolbox according to claim 3 wherein the first lock comprises a latch movably put in related one of the sub-frames and a switch connected with the latch.

5. The toolbox according to claim 4 wherein the latch comprises a rear protrusion for contacting the first holder.

6. The toolbox according to claim 5 wherein the front wall defines an aperture through which the rear protrusion is extensible to the first holder.

7. The toolbox according to claim 4 wherein the switch comprises two hooks for hooking the latch.

8. The toolbox according to claim 7 wherein the frame defines a window through which the hooks are extensible to the latch.

9. The toolbox according to claim 4 wherein the first lock comprises a spring for biasing the latch.

10. The toolbox according to claim 3 wherein the second lock comprises a latch movably put in related one of the sub-frames and a switch connected with latch.

11. The toolbox according to claim 10 wherein the latch comprises a rear protrusion for contacting the second holder.

12. The toolbox according to claim 11 wherein the front wall defines an aperture through which the rear protrusion is extensible to the second holder.

13. The toolbox according to claim 10 wherein the switch comprises two hooks for hooking the latch.

14. The toolbox according to claim 13 wherein the frame defines a window through which the hooks are extensible to the latch.

15. The toolbox according to claim 10 wherein the second lock comprises a spring for biasing the latch.

16. The toolbox according to claim 1 wherein the first elastic element is a torque spring.

17. The toolbox according to claim 1 wherein the second elastic element is a torque spring.

18. A toolbox comprising a body, a first holder pivotally connected with the body between a lie-down position and a stick-out position, a first elastic element for biasing the first holder to the stick-out position, a first lock for locking the first holder in the lie-down position, a second holder pivotally connected with the body between a lie-down position and a stick-out position, a second elastic element for biasing the second holder to the stick-out position, and a second lock for locking the second holder in the lie-down position, wherein the body comprises a front wall, a rear wall and a board extending between the front and rear walls, wherein the first holder is pivotally connected with the front and rear walls of the body.

19. The toolbox according to claim 18 wherein the first elastic element is a torque spring.

20. The toolbox according to claim 18 wherein the second elastic element is a torque spring.

* * * * *